US006446716B1

(12) United States Patent
Marchal et al.

(10) Patent No.: US 6,446,716 B1
(45) Date of Patent: Sep. 10, 2002

(54) WORKING ENCLOSURE PROVIDED WITH MEANS FOR RECYCLING THE ATMOSPHERE

(75) Inventors: Norbert Marchal, Cholet; Laurent Mimaud, Nantes, both of (FR)

(73) Assignee: Jouan (FR)

( * ) Notice: Subject to any disclaimer, the term of this patent is extended or adjusted under 35 U.S.C. 154(b) by 0 days.

(21) Appl. No.: 09/610,354

(22) Filed: Jul. 5, 2000

(30) Foreign Application Priority Data

Jul. 6, 1999 (FR) ..... 99 08716

(51) Int. Cl.[7] ..... E28B 29/00

(52) U.S. Cl. ..... 165/253; 165/75; 165/86; 361/616; 361/605; 219/522

(58) Field of Search ..... 165/74, 75, 86, 165/122, 253; 454/184; 361/605, 613, 616, 690, 676, 677, 678; 422/109; 219/408, 522, 520; 55/385.2, 385.4

(56) References Cited

U.S. PATENT DOCUMENTS 3,784,754 A 4/1975 Saunders et al.
4,449,579 A * 5/1984 Miyazaki et al. ..... 165/104.34
5,090,476 A * 2/1992 Immel ..... 165/122
5,792,427 A 4/1998 Hugh et al.
6,067,233 A * 5/2000 Diebel et al. ..... 165/104.33
6,164,369 A * 12/2000 Stoller ..... 361/696
6,170,562 B1 * 1/2001 Knoblauch ..... 165/122

FOREIGN PATENT DOCUMENTS

| | | |
|---|---|---|
| DE | 296 22 079 | 8/1997 |
| EP | 0 195 703 | 9/1986 |
| GB | 1 396 883 | 6/1975 |
| WO | WO 90/05549 | 5/1990 |
| WO | WO 95/34078 | 5/1995 |

* cited by examiner

*Primary Examiner*—Henry Bennett
*Assistant Examiner*—Terrell McKinnon
(74) *Attorney, Agent, or Firm*—Larson & Taylor, PLC

(57) ABSTRACT

A working enclosure includes a working chamber whose walls delimit a confinement space for working in and an exterior branch loop for recycling the atmosphere of the confinement space. The branch loop opens at each end into the confinement space and includes means for circulating the atmosphere in the branch loop. The working enclosure includes filter members at each end of the branch loop.

7 Claims, 3 Drawing Sheets

WORKING ENCLOSURE PROVIDED WITH MEANS FOR RECYCLING THE ATMOSPHERE

FIELD OF THE INVENTION

The present invention relates to a working enclosure of the type including a working chamber whose walls delimit a confinement space for working in and an external branch loop for recycling the atmosphere of the confinement space and which opens into the confinement space at both ends and includes means for circulating the atmosphere in the branch loop.

BACKGROUND OF THE INVENTION

Conventional working enclosures of the above kind are routinely thermostatically controlled so that the confinement space is maintained at constant temperature and auxiliary systems are routinely used to procure a high relative humidity.

Enclosures of the above kind are used for working in a controlled atmosphere, for example. One example of such work is the culture of animal cells or embryos. In this case the $CO_2$ and water vapour content of the atmosphere in the confinement space in particular are monitored.

Depending on the use to which the enclosure is put, it can be contaminated by undesirable germs which develop in the confinement space.

Recycling the atmosphere of the enclosure via an external branch loop provided for this purpose enables continuous treatment, and in particular filtering, of the atmosphere of the enclosure.

A fan or a pump is mounted in the branch to circulate the atmosphere.

A filter is provided at the entry end of the pipe constituting the branch loop relative to the normal direction of flow of the atmosphere in the loop. It holds back contaminating elements when the atmosphere of the enclosure is circulated.

An enclosure of the above kind works well if the fan or the pump is not stopped and the atmosphere circulates through the branch loop.

Contamination of the branch loop is possible if the operation of the pump is interrupted. It is then necessary to decontaminate the whole of the branch loop before restarting the enclosure, which necessitates a great deal of work.

Also, if work on the branch loop necessitates stopping the pump, it is necessary to decontaminate both the confinement space and the branch loop before returning the enclosure to service.

SUMMARY OF THE INVENTION

An object of the invention is to propose a working enclosure which limits the need for manual decontamination of the confinement space and the branch loop.

To this end, the invention provides a working enclosure of the above type characterized in that it includes filter members at each end of said branch loop.

Particular embodiments of the enclosure have one or more of the following features:

- the filtration members at each end of the branch loop extend the wall of the chamber through which the branch loop opens;
- the working chamber includes a containment vessel and a door mobile relative to the containment vessel and shutting off an access to said containment space and the branch loop is carried by the door, each end of the branch loop opens via the door, and the filter members are carried by the door at each end of the branch loop;
- the door has over most of its surface a thermostatically controlled box-section and said branch loop extends over most of its length inside said thermostatically controlled box-section;
- the working chamber includes a containment vessel and a door mobile relative to the containment vessel and shutting off an access to said confinement space and each end of the branch loop opens through walls of the containment vessel;
- the containment vessel is at least partly surrounded by a thermostatically controlled jacket and said branch loop extends over most of its length inside said thermostatically controlled jacket; and
- the containment vessel is at least partly surrounded by a thermostatically controlled jacket filled with a heat-conducting liquid and said branch loop passes through said jacket and extends over the greater part of its length in a thermostatically controlled box-section adjacent said jacket, which box-section contains a gas.

BRIEF DESCRIPTION OF THE DRAWINGS

The invention will be better understood after reading the following description, which is given by way of example only and with reference to the accompanying drawings, in which.

DETAILED DESCRIPTION OF THE INVENTION

Figure 1:
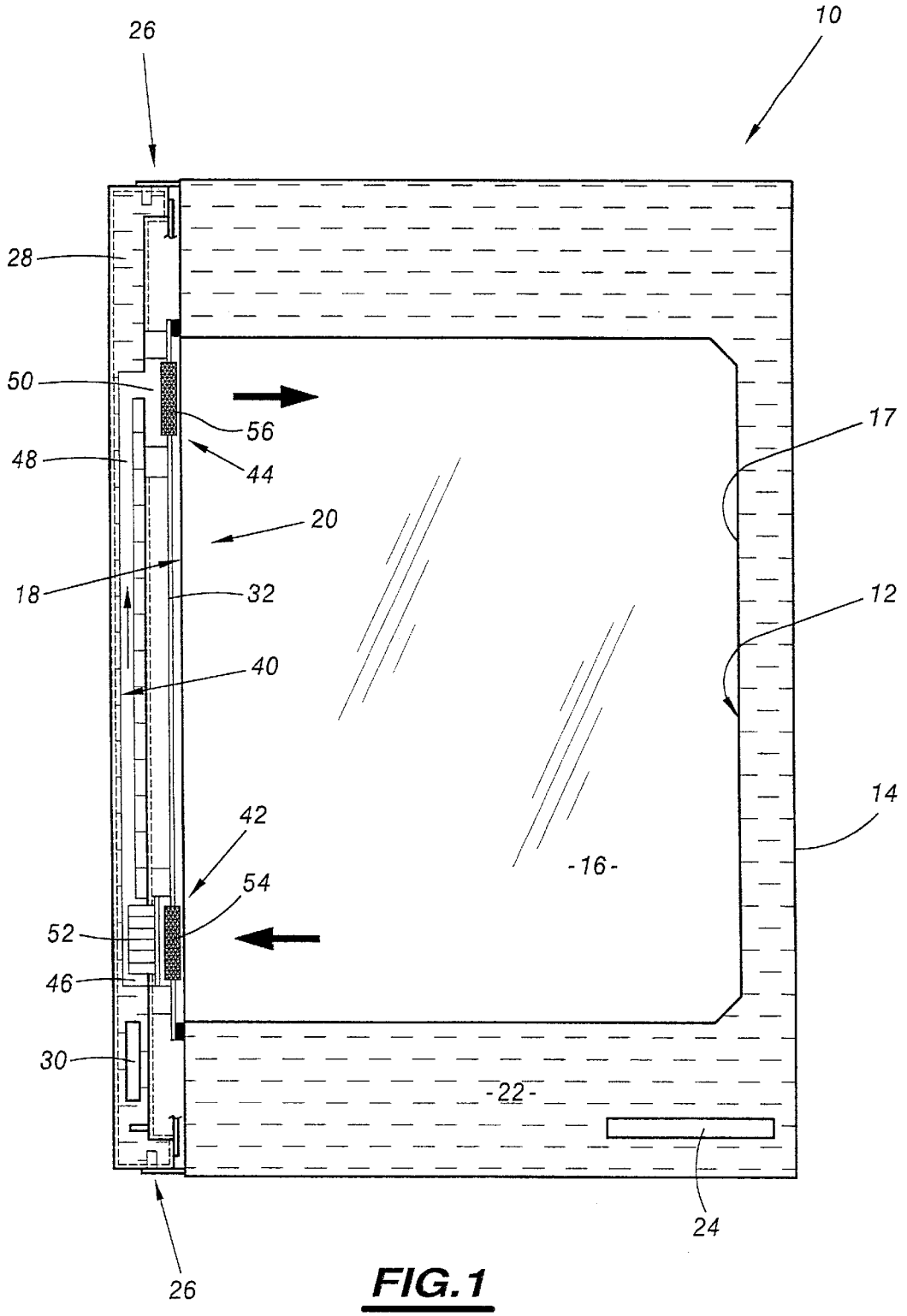
FIG. 1 is a diagrammatic view of an enclosure according to the invention in cross section in a vertical plane passing through the entry opening of the enclosure.

The working enclosure 10 shown in FIG. 1 includes a working chamber 12 inside a thermostatically controlled box 14. The working chamber delimits a confinement space 16 for working in, for example for incubating cells or embryos. In the conventional way, the enclosure 10 is equipped with means for monitoring the atmosphere of the confinement space and in particular its $CO_2$ and water vapour content.

The working chamber 12 consists of a substantially parallelepiped-shaped containment vessel 17 one face 18 of which is open. That face is closed by an articulated door 20 adapted to seal an access opening to the confinement space 16.

The containment vessel 17 which partly delimits the working chamber 12 is accommodated entirely within the thermostatically controlled box 14. The latter forms a jacket 22 all around the working chamber 12, except for its open face 18. The jacket 22 formed in this way is filled with a heat-conducting liquids such as water. The solid walls of the containment vessel 17 are in contact with the heat-conducting liquid.

Means 24 for regulating the temperature of the heat-conducting liquid, such as resistive heating elements, are installed in the thermostatically controlled box 14.

The door 20 is articulated to the thermostatically controlled box 14 by means of hinges 26. The door can be moved between a position allowing access to the confinement space 16 via the open face 18 of the working chamber and a position closing the face 18.

The door 20 has a frame delimited by a sealed box-section 28 filled with a heat-conducting fluid such as water. Means 30 for regulating the temperature of the heat-conducting fluid, such as resistive heating elements, are provided inside the box-section 28. The box-section 28 is therefore thermostatically controlled and can advantageously be maintained at the same temperature as the jacket 22.

The face of the door 20 facing the chamber 12 incorporates a plate 32 for sealing off the confinement space 16. The plate 32 is slightly larger than the open face 18 of the containment vessel. It is adapted to be applied to the edges of the containment vessel in order to seal it hermetically. A peripheral seal is advantageously provided for this purpose.

A branch loop 40 for recycling the atmosphere in the confinement space 16 is integrated into the interior of the door 20. The branch loop opens at both ends into the interior of the working chamber 12 via the open face 18 thereof.

The branch loop 40 extends from an entry opening 42 to an exit opening 44, both of which are formed in the closure plate 32. A suction intake 46 is provided to the rear of the entry opening 42, which is extended by a duct 48 extending the length of the door inside the box-section 28. The duct 48 is therefore immersed in the heat-conducting fluid.

The branch loop opens at the exit end 44 via a vent 50.

A ventilator 52 or a compressor a pump is mounted inside the suction intake 46 to circulate the atmosphere through the branch loop 40.

According to the invention, respective filter units 54, 56 are provided at the entry and exit ends of the branch loop 40. The filter units are identical and are high-efficiency particle air (HEPA) filters, for example. The filters have a mesh diameter of 0.2 $\mu$m, for example.

The filter units 54 and 56 are contained within the thickness of the plate 32 and therefore ensure the continuity of this wall of the chamber.

Clearly the branch loop 40 equipped with the fan 52 enables continuous circulation of the atmosphere in the confinement space. Contaminating particles contained in the atmosphere are held back by the filter unit 54 mounted at the entry 42 of the branch loop.

When the enclosure is operating normally, i.e. when the fan 52 is running, the filter unit 56 does not as such contribute to filtering the atmosphere of the enclosure.

On the other hand, if the fan 52 is stopped, with no flow in the branch loop 40, the filter unit 56 prevents contaminants entering the branch loop 40 via the exit opening 44.

Likewise, if the door 20 is opened, the two filters 54 and 56 prevent any contamination of the interior of the branch loop 40.

Most of the length of the branch loop 40 is inside the thermostatically controlled box-section 28 and the atmosphere is therefore not subjected to any variation of temperature as it passes through the loop 40.

Figure 2:
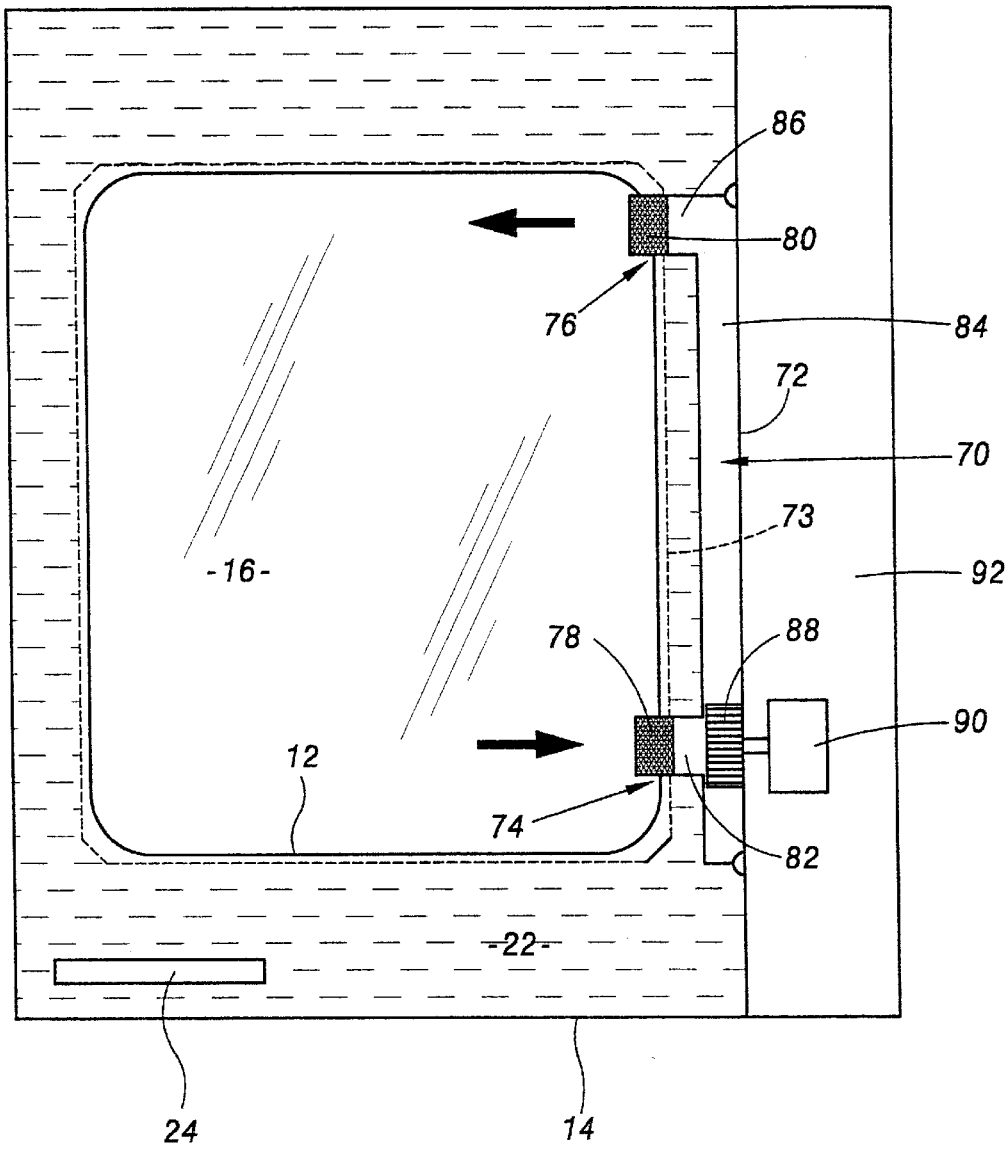
FIGS. 2 and 3 are diagrammatic views of two embodiments of working enclosure according to the invention in cross section in vertical section planes parallel to the entry opening of the enclosure.
Figure 3:
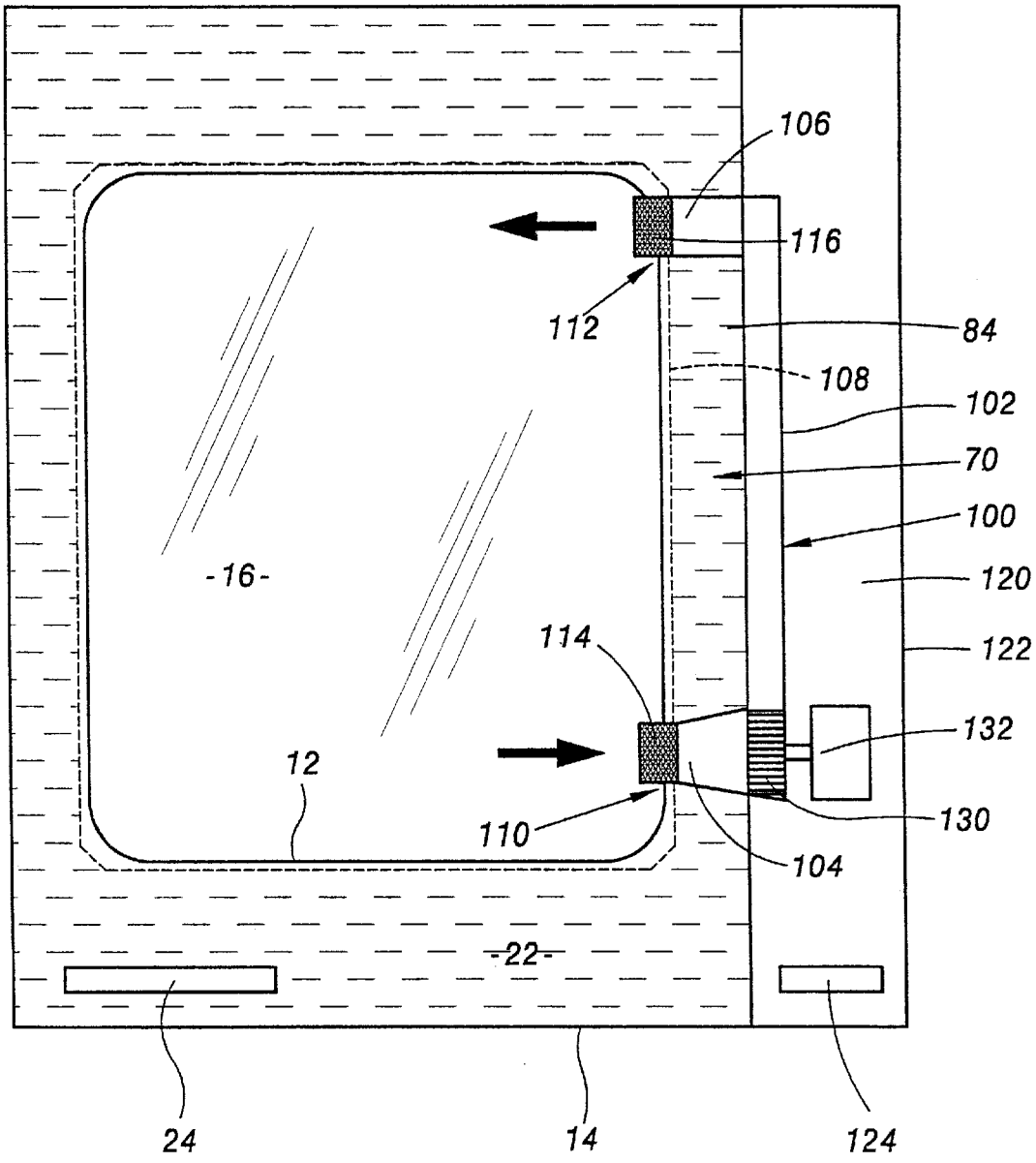

In the embodiments of the invention shown in FIGS. 2 and 3 elements identical or similar to those shown in FIG. 1 are designated by the same reference numbers.

In the FIG. 2 embodiment of the invention the branch loop 70 is not in the door for closing off the confinement space 16. That door is not shown, but is parallel to and in front of the plane of the figure. The branch loop 70 is inside the jacket 22 delimited by the box 14 and the working chamber 12.

To be more precise, the branch loop 70 extends along an exterior lateral wall 72 of the box. The branch loop 70 opens via a lateral wall 73 of the containment vessel. To this end, that wall has an entry opening 74 in it through which the atmosphere in the confinement space is collected and an exit opening 76 in it through which the filtered atmosphere is returned.

Each opening 74 and 76 is fitted with a respective filter unit 78 and 80. The filter units are integrated into the thickness of the wall 73 and have a mesh diameter of 0.2 $\mu$m, for example.

As in the previous embodiment, the branch loop includes a suction intake 82 downstream of the filter 78, a duct 84 and a vent 86 opening into the confinement space 16 via the filter 76.

A fan is mounted in the branch loop. It has a rotor 88 in the duct 84 downstream of the suction intake 82. The rotor 88 is rotated by an electric motor 90 which is outside the thermostatically controlled box 14 and inside an auxiliary cabinet 92.

In this embodiment the filter 78 captures contaminants during continuous circulation of the atmosphere of the working space through the branch loop 70.

If the fan is stopped, the filter 80 prevents contaminants entering the branch loop 70, so avoiding the need to decontaminate the branch loop 70 before the enclosure is used again.

In the FIG. 3 embodiment of the invention the branch loop 100 includes a duct 102 which connects a suction intake 104 to a vent 106. The intake and the vent open into the space 16 via a lateral wall 108 in which openings 110, 112 are formed. Each opening is equipped with a filter 114, 116. The duct 102 is no longer inside the jacket 22 filled with heat-conducting fluid, but instead in an adjacent thermostatically controlled area 120. The area 120 is delimited by a cabinet 122 and is filled with air. Resistive heating elements 124 are placed inside the cabinet 122 to maintain the temperature in the area 120 substantially equal to that of the jacket 22.

A fan rotor 130 is mounted in the branch loop 100. Its drive motor 132 is inside the thermostatically controlled area 120.

In this embodiment the filter 116 prevents contaminants entering the branch loop 100 if the fan is stopped.

Maintenance of the branch loop is facilitated because the duct 102 is no longer inside the jacket 22 filled with heat-conducting liquid, but instead in an adjacent thermostatically controlled area which is open to the atmosphere. However, transportation of the atmosphere from the confinement space through the duct 102 while it is being filtered does not vary its temperature, because the area 120 is also thermostatically controlled. This reduces the risk of condensation.

Whichever embodiment of the invention is used, if work has to be carried out on the branch loop, in particular on the fan, it is not necessary to decontaminate the working enclosure when work resumes because the enclosure is protected from contaminants introduced into the branch loop by the filters at both ends thereof.

What is claimed is:

1. A working enclosure comprising a working chamber whose walls delimit a confinement space for working in and an exterior branch loop for recycling the atmosphere of the confinement space, which branch loop opens at each end into the confinement space and includes means for circulating the atmosphere in the branch loop, wherein the working enclosure includes filter members at each end of said branch loop, wherein the working chamber includes a containment vessel and a door mobile relative to the containment vessel and shutting off an access to said confinement space and wherein each end of the branch loop opens through walls of the containment vessel, the containment vessel being at least partly surrounded by a thermostatically controlled jacket filled with a heat-conducting liquid and wherein said branch loop passes through said jacket and extends over the greater part of its length in a thermostatically controlled box-section adjacent said jacket, which box-section contains a gas.

2. The working enclosure according to claim 1, wherein the filter members at each end of the branch loop extend the wall of the chamber through which the branch loop opens.

3. A working enclosure comprising a working chamber whose walls delimit a confinement space for working in and an exterior branch loop for recycling the atmosphere of the confinement space, which branch loop opens at each end into the confinement space and includes means for circulating the atmosphere in the branch loop, wherein the working enclosure includes filter members at each end of said branch loop, wherein the working chamber includes a containment vessel and a door mobile relative to the containment vessel and shutting off an access to said confinement space and wherein each end of the branch loop opens through walls of the containment vessel, the containment vessel being at least partly surrounded by a thermostatically controlled jacket and wherein said branch loop extends over most of its length inside said thermostatically controlled jacket.

4. The working enclosure according to claim 3, wherein the filter members at each end of the branch loop extend the wall of the chamber through which the branch loop opens.

5. A working enclosure comprising a working chamber whose walls delimit a confinement space for working in and an exterior branch loop for recycling the atmosphere of the confinement space, which branch loop opens at each end into the confinement space and includes means for circulating the atmosphere in the branch loop, wherein the working enclosure includes filter members at each end of said branch loop, wherein the working chamber includes a containment vessel and a door mobile relative to the containment vessel and shutting off an access to said containment space and wherein the branch loop is carried by the door, each end of the branch loop opens via the door, and the filter members are carried by the door at each end of the branch loop.

6. The working enclosure according to claim 5, wherein the filter members at each end of the branch loop extend the wall of the chamber through which the branch loop opens.

7. The working enclosure according to claim 5, wherein the door has over most of its surface a thermostatically controlled box-section and wherein said branch loop extends over most of its length inside said thermostatically controlled box-section.

* * * * *